US010478039B2

(12) United States Patent
Gunn

(10) Patent No.: US 10,478,039 B2
(45) Date of Patent: Nov. 19, 2019

(54) UNDERCOUNTER APPLIANCE DRAIN PAN

(71) Applicant: ARMORY PRODUCTS, INC., Richmond, VA (US)

(72) Inventor: Matthew M. Gunn, Richmond, VA (US)

(73) Assignee: ARMORY PRODUCTS, INC., Richmond, VA (US)

( * ) Notice: Subject to any disclaimer, the term of this patent is extended or adjusted under 35 U.S.C. 154(b) by 0 days.

(21) Appl. No.: 16/195,164

(22) Filed: Nov. 19, 2018

(65) Prior Publication Data

US 2019/0183313 A1 Jun. 20, 2019

Related U.S. Application Data

(63) Continuation of application No. 15/921,619, filed on Mar. 14, 2018, now Pat. No. 10,159,396.

(60) Provisional application No. 62/599,947, filed on Dec. 18, 2017.

(51) Int. Cl.

| | |
|---|---|
| ***B65D 1/34*** | (2006.01) |
| ***A47L 15/42*** | (2006.01) |
| ***B65D 25/38*** | (2006.01) |
| ***D06F 39/12*** | (2006.01) |
| *B65D 1/36* | (2006.01) |
| *D06F 39/08* | (2006.01) |

(52) U.S. Cl.

CPC ..... *A47L 15/421* (2013.01); *B65D 25/38* (2013.01); *D06F 39/125* (2013.01); *D06F 39/081* (2013.01)

(58) Field of Classification Search

CPC ..... A47L 15/421; B65D 25/38; D06F 39/081; D06F 39/125

USPC ..... 220/573, 571

See application file for complete search history.

(56) References Cited

U.S. PATENT DOCUMENTS

| | | | | | |
|---|---|---|---|---|---|
| 973,474 | A * | 10/1910 | Cameron | B60K 15/077 | 137/550 |
| 1,487,065 | A * | 3/1924 | Irons | F25D 21/14 | 220/571 |
| 3,353,615 | A * | 11/1967 | Nekimken | B67D 1/16 | 177/225 |
| 4,243,197 | A * | 1/1981 | Wright | D06F 39/081 | 220/DIG. 6 |
| 5,351,931 | A * | 10/1994 | Houben | D21F 13/02 | 162/382 |
| 6,718,993 | B1 * | 4/2004 | DeMartini | A47L 15/421 | 134/115 R |
| 6,941,703 | B2 * | 9/2005 | MacLean | A01K 1/0103 | 137/312 |
| 8,347,426 | B2 * | 1/2013 | Valdenaire | A47K 3/405 | 4/613 |
| 2009/0261109 | A1 * | 10/2009 | Mirza | F16N 31/002 | 220/571 |

(Continued)

*Primary Examiner* — J. Gregory Pickett
*Assistant Examiner* — Niki M Eloshway
(74) *Attorney, Agent, or Firm* — Patent Law of Virginia, PLLC; Brian J. Teague

(57) ABSTRACT

An appliance drain pan comprises a continuous upturned rim around an outer edge of the drain pan, the rim having a top edge; horizontal left and right side support ledges enclosed by the rim; and a central depression between the horizontal left and right side support ledges. The central depression is deeper than side support ledges relative to the top edge of the rim. At least a portion of the central depression extends under at least a portion of each of the side support ledges.

16 Claims, 10 Drawing Sheets

(56) References Cited

U.S. PATENT DOCUMENTS

| | | | | |
|---|---|---|---|---|
| 2010/0018980 | A1* | 1/2010 | Oakner | F24F 13/22 220/571 |
| 2010/0243661 | A1* | 9/2010 | Upham | A47L 15/4212 220/571 |
| 2010/0251646 | A1* | 10/2010 | MacLean | E03F 5/0402 52/302.1 |
| 2015/0330699 | A1* | 11/2015 | Hawley, III | B65D 25/38 220/571 |

* cited by examiner

UNDERCOUNTER APPLIANCE DRAIN PAN

CROSS-REFERENCE TO RELATED APPLICATIONS

This application is a continuation of and claims priority to pending U.S. patent application Ser. No. 15/921,619, filed Mar. 14, 2018, which in turn claims priority to U.S. Provisional Application Ser. No. 62/599,947, filed Dec. 18, 2017, the contents of which are incorporated herein by reference in their entirety.

FIELD OF THE INVENTION

The present invention relates generally to appliance drain pans.

BACKGROUND OF THE DISCLOSURE

Some household appliances are connected to the household water supply, such as dishwashers, washing machines, standalone icemakers, and refrigerator/freezers with built-in water/ice dispensing. A leak in a water supply line or in the internal plumbing or other components of such an appliance can cause flooding in the house, resulting in significant and expensive property damage.

It is known to sit a washing machine in a conventional drain pan. Such a conventional drain pan typically has a large generally planar floor and four upwardly projecting walls, forming a watertight vessel. Such a drain pan typically has a hole and fitting to connect a drain hose to drain any water in the drain pan to a safe location. Because there are four upwardly projecting walls (which are typically about 1-2 inches high), the washing machine needs to be lifted up and placed into the drain pan.

Such conventional drain pans will not work for appliances that are mounted under a counter, such as dishwashers and standalone icemakers. Such undercounter appliances are installed by sliding the appliance into position under the counter. It is not possible to lift such an appliance into a conventional drain pan that has four upwardly projecting walls.

It is known to install a drip pan or leak pan under an undercounter appliance. Such a drip pan has a large generally planar floor and three upwardly projecting walls (a rear wall and two side walls). Such a drip pan has no front wall to allow the appliance to be slid into position under the counter. Because there is no front wall, the drip pan merely redirects any leaking water to the front of the appliance where it will (hopefully) be noticed before any significant damage occurs. However, if the leaking water is not quickly noticed, significant damage is likely to occur.

BRIEF SUMMARY OF THE DISCLOSURE

In one embodiment of the invention, an appliance drain pan comprises an upturned rim around an outer edge of the drain pan, a horizontal rear ledge, a horizontal front ledge, horizontal left and right side support ledges, and a central depression between the rear and front ledges. The central depression is deeper than the rear, front, and side support ledges relative to a top edge of the rim. At least a portion of the central depression extends under at least a portion of each of the side support ledges.

The rear, front, and side support ledges may be unitary.

Each side support ledge may comprise an elongated beam removably positionable on the rear and front ledges with one end of each side support ledge sitting on the rear ledge and an opposing end of each side support ledge sitting on the front ledge, such that each side support ledge is positioned over an opposing end of the central depression.

One or more drain holes may be defined in each side support ledge, each drain hole being positioned over the central depression.

The drain pan may further comprise left and right support pillars projecting upward from the central depression. Each support pillar contacts an underside of a corresponding side support ledge to support the corresponding side support ledge.

The central depression may comprise a rear sloped wall adjacent the rear ledge, a front sloped wall adjacent the front ledge, and a horizontal floor. At least part of the horizontal floor is between the rear and front sloped walls. The rear sloped wall may comprise a vertical wall portion adjacent the rear ledge. The front sloped wall may comprise a vertical wall portion adjacent the front ledge. A portion of the horizontal floor may extend to the vertical wall portion of the rear sloped wall. A portion of the horizontal floor may extend to the vertical wall portion of the front sloped wall.

A drain hole may be defined in the central depression.

In an alternative embodiment of the invention, an appliance drain pan comprises an upturned rim around an outer edge of the drain pan, a horizontal rear ledge, a horizontal front ledge, horizontal left and right side support ledges, and a central depression between the rear and front ledges. The central depression is deeper than the rear, front, and side support ledges relative to a top edge of the rim. The central depression comprises a rear sloped wall adjacent the rear ledge, a front sloped wall adjacent the front ledge, and a horizontal floor. At least part of the horizontal floor is between the rear and front sloped walls. The rear sloped wall comprises a vertical wall portion adjacent the rear ledge. The front sloped wall comprises a vertical wall portion adjacent the front ledge. A portion of the horizontal floor extends to the vertical wall portion of the rear sloped wall. A portion of the horizontal floor extends to the vertical wall portion of the front sloped wall.

At least a portion of the central depression may extend under at least a portion of each of the side support ledges.

Other features of this embodiment may be as described above.

Another alternative embodiment of the invention is a method of installing an appliance. The appliance comprises a left rear leg, a right rear leg, a left front leg, and a right front leg. The method comprises (a) cutting and/or forming an installation hole in a floor in a location where the appliance is to be installed; (b) obtaining an appliance drain pan as described above; (c) positioning the drain pan such that the rear ledge sits on a rear edge of the installation hole, the front ledge sits on a front edge of the installation hole, and the central depression sits down in the installation hole; and (d) sliding and/or lifting the appliance into position on top of the drain pan along the side support ledges. Other features of the drain pan of this method may be as described above.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
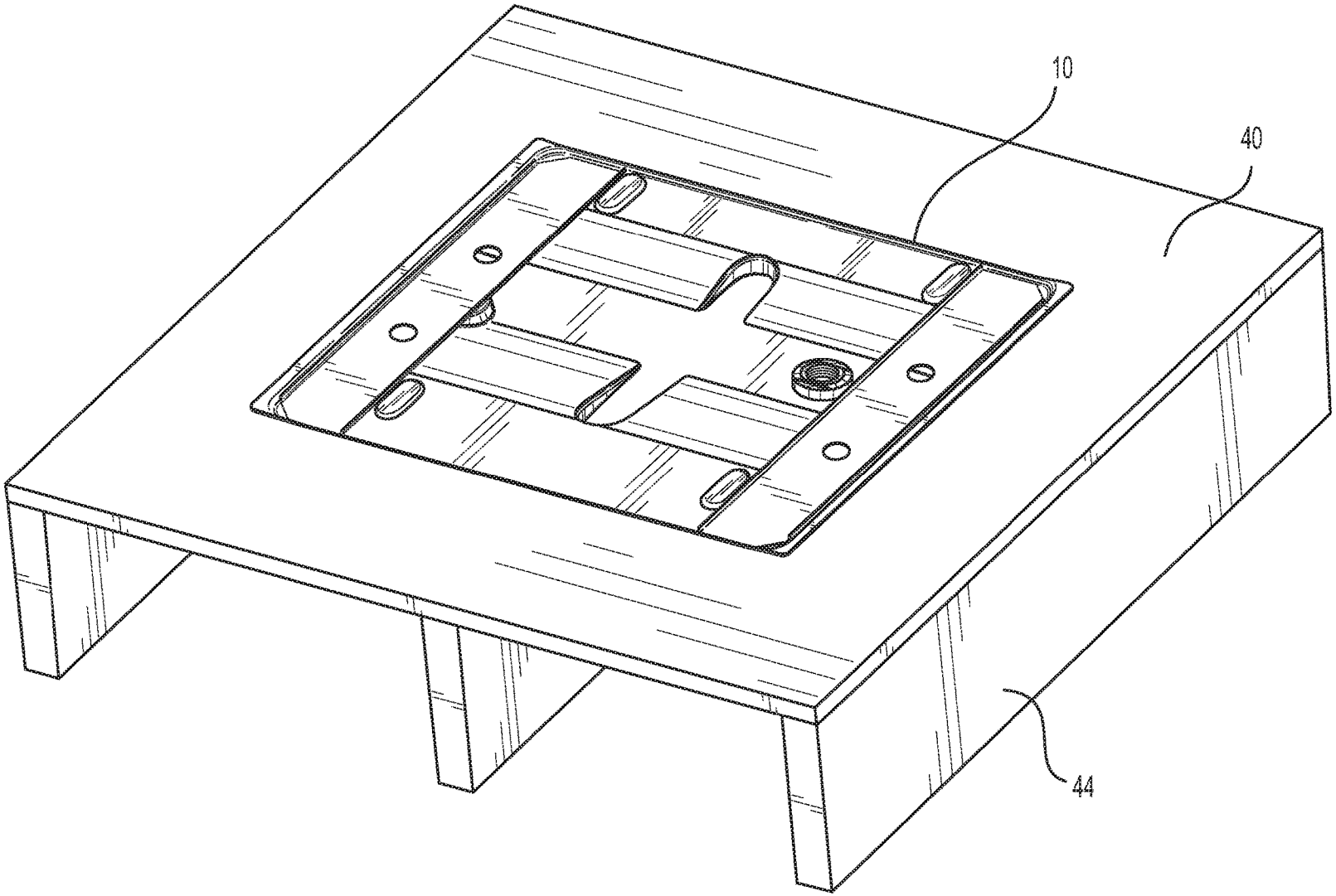
FIG. 1 is a perspective view of an undercounter appliance drain pan installed in a floor, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention comprise an appliance drain pan that can be used under an undercounter appliance. The drain pan of embodiments of the invention has a low profile that enables an undercounter appliance to be readily slid into place on top of the drain pan. Despite its low profile, the drain pan of embodiments of the invention is able to capture and divert a large amount of water because a portion of the drain pan projects downward into an installation hole cut into the flooring (e.g., subfloor or hardwood floor) below a portion of the drain pan. The downwardly projecting portion increases the total water-holding volume of the drain pan without the need for higher walls as in conventional drain pans.

Figure 2:
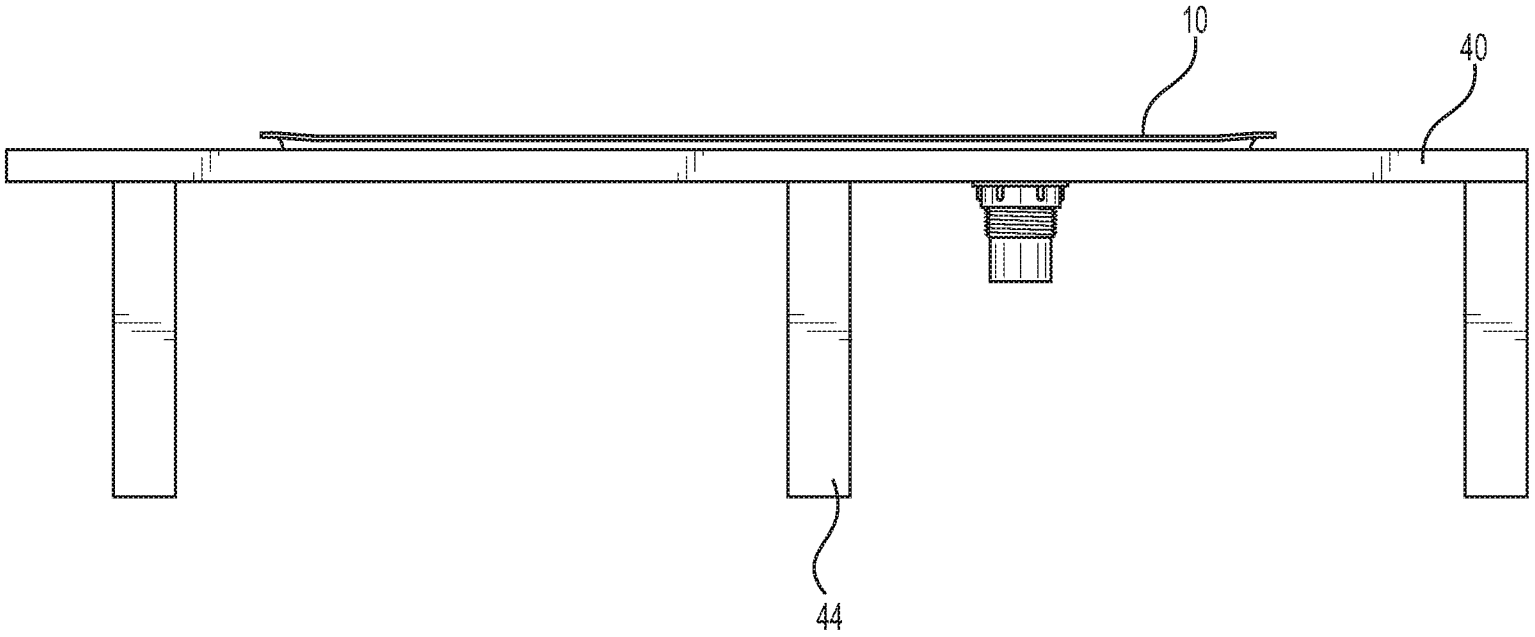
FIG. 2 is a side view of the drain pan of FIG. 1 installed in a floor.
Figure 3:
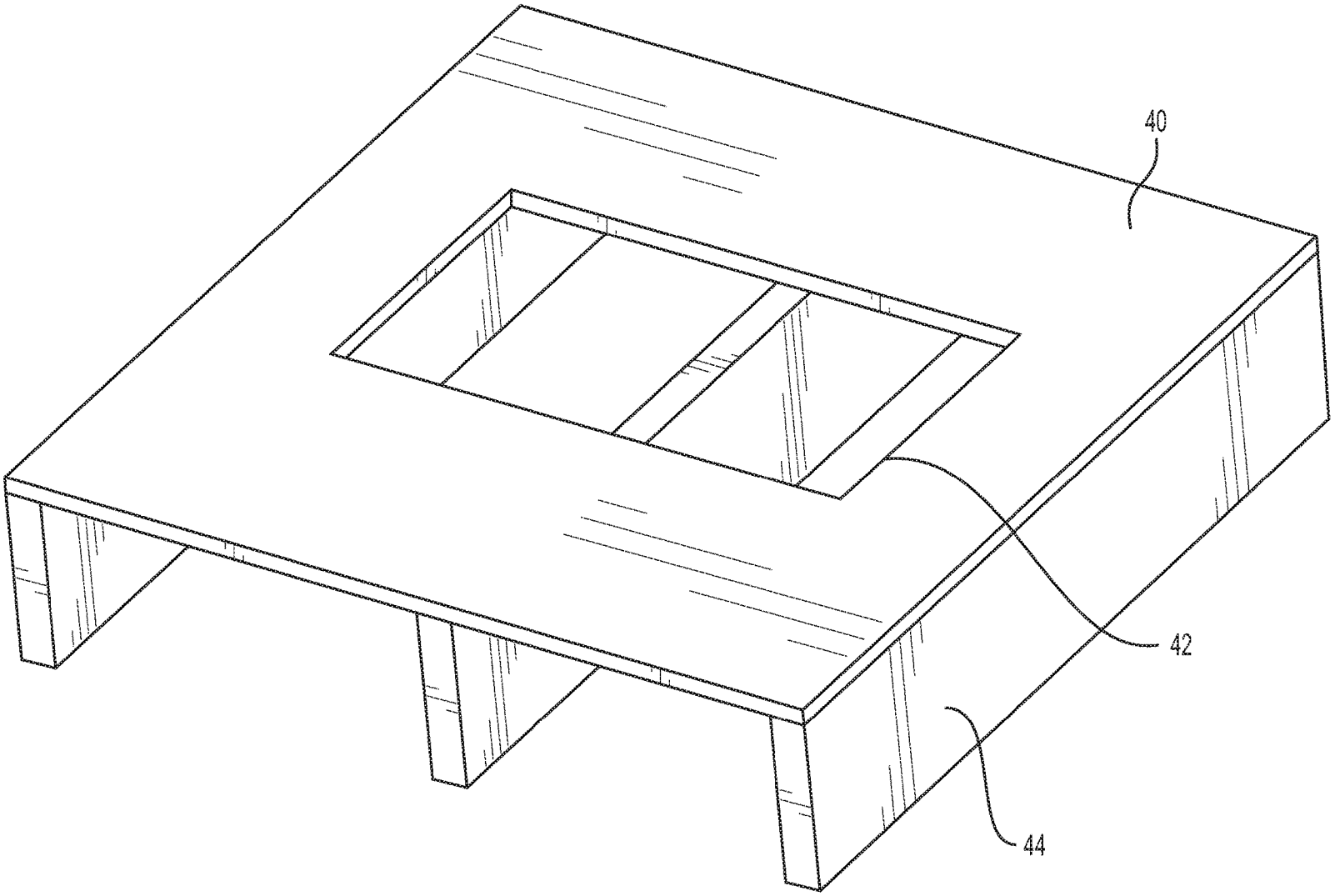
FIG. 3 is a perspective view of an installation hole for installing the drain pan of FIG. 1.

Referring now to FIGS. 1-7, the drain pan 10 of embodiments of the invention is installed such that a portion of the drain pan 10 projects downward into an installation hole 42 (illustrated in FIG. 3) cut through the flooring 40 (which sits on joists 44). The flooring 40 may comprise a subfloor alone or may comprise finished flooring (for example, hardwood floors) and a subfloor upon which the finished flooring is installed. FIGS. 1-3 illustrate only a portion of a floor in which the drain pan may be installed, and omits for clarity the cabinets between which and the countertop under which a dishwasher would be installed. In practice, the drain pan of embodiments of the invention would be installed in the floor in the dishwasher opening (i.e., the open space between two cabinets in which the dishwasher will be installed), positioned such that the legs of the dishwasher sit on the side support beams (30 in FIGS. 1-7) or side support flanges (130 in FIG. 8 or 230 in FIGS. 9 and 10) when the dishwasher is installed. The visible ends of the joists 44 in FIG. 1 correspond to the front side of the drain pan 10 when installed, and the side support beams (30 in FIGS. 1-7) or side support flanges (130 in FIG. 8 or 230 in FIGS. 9 and 10) are positioned front-to-back when installed. As described further below, the size and shape of the installation hole 42 corresponds to the deeper portion 16 of the drain pan (i.e., the portion intended to project down through the hole), leaving the shallow portions of the drain pan sitting on top of the flooring to support the drain pan 10. As seen in FIG. 2, the drain pan 10 has a very low profile above the flooring 40, such that in the illustrated embodiment the drain pan 10 has a height of only about 0.4 inches above the flooring 40.

The drain pan 10 has an overall generally rectangular shape, which corresponds to the shape of the appliance (it is preferable that the entire footprint of the appliance be above the drain pan to ensure that any leaking water is captured). In the illustrated embodiment, the drain pan 10 comprises three separate components—the water-holding portion 12 and two appliance support beams 30 on opposing sides of the water-holding portion 12. The water-holding portion 12 is typically constructed of any suitable material that is watertight and sturdy and rigid enough to holds its shape when full of water, such as any suitable plastic. In one embodiment of the invention, the water-holding portion 12 is constructed of ABS plastic with a thickness of about 0.09 inches. The appliance support beams 30 are typically constructed of any suitable material that is sturdy enough and rigid enough to support the appliance, such as any suitable metal. In one embodiment of the invention, the appliance support beams 30 are constructed of 16-gauge steel.

The water-holding portion 12 comprises a front shallow portion 14*a*, a rear shallow portion 14*b*, and a deeper portion 16 therebetween. The front and rear shallow portions 14*a*, 14*b* are generally flat, such that the front shallow portion 14*a* sits on the flooring 40 in front of the installation hole 42 and the rear shallow portion 14*b* sits on the flooring 40 behind the installation hole 42. In this regard, the front and rear shallow portions 14*a*, 14*b* support the drain pan on the flooring while the deeper portion 16 projects downward into the installation hole 42. The deeper portion 16 slopes downward from the front and rear shallow portions 14*a*, 14*b* to a generally flat central portion. A drain hole 26 is defined in the central portion of the deeper portion 16. The drain hole 26 may include the necessary fitting 28 to connect a drain hose for directing any captured water to an appropriate household drain or to the outside of the house. The drain pan may be provided without a drain hole, but with instructions for having an installer cut or drill a drain hole in a desired location on the drain pan, thereby enabling the installer to position the drain hole to avoid any obstructions (e.g., joists).

An upwardly-projecting rim 18 surrounds the water-holding portion 12. The rim 18 is tall enough to ensure that any water that leaks into the shallow portions 14*a*, 14*b* of the water-holding portion 12 does not flow out of the drain pan but rather flows from the shallow portions 14*a*, 14*b* to the deeper portion 16, but short enough to provide the desired low profile of the drain pan. In the illustrated embodiment, the rim is about 0.4 inches tall. During installation, an appliance is readily lifted over the front wall of the rim, even with the counter limiting the amount the appliance can be lifted, because the rim is so low as compared to conventional drain pans.

Figure 4:
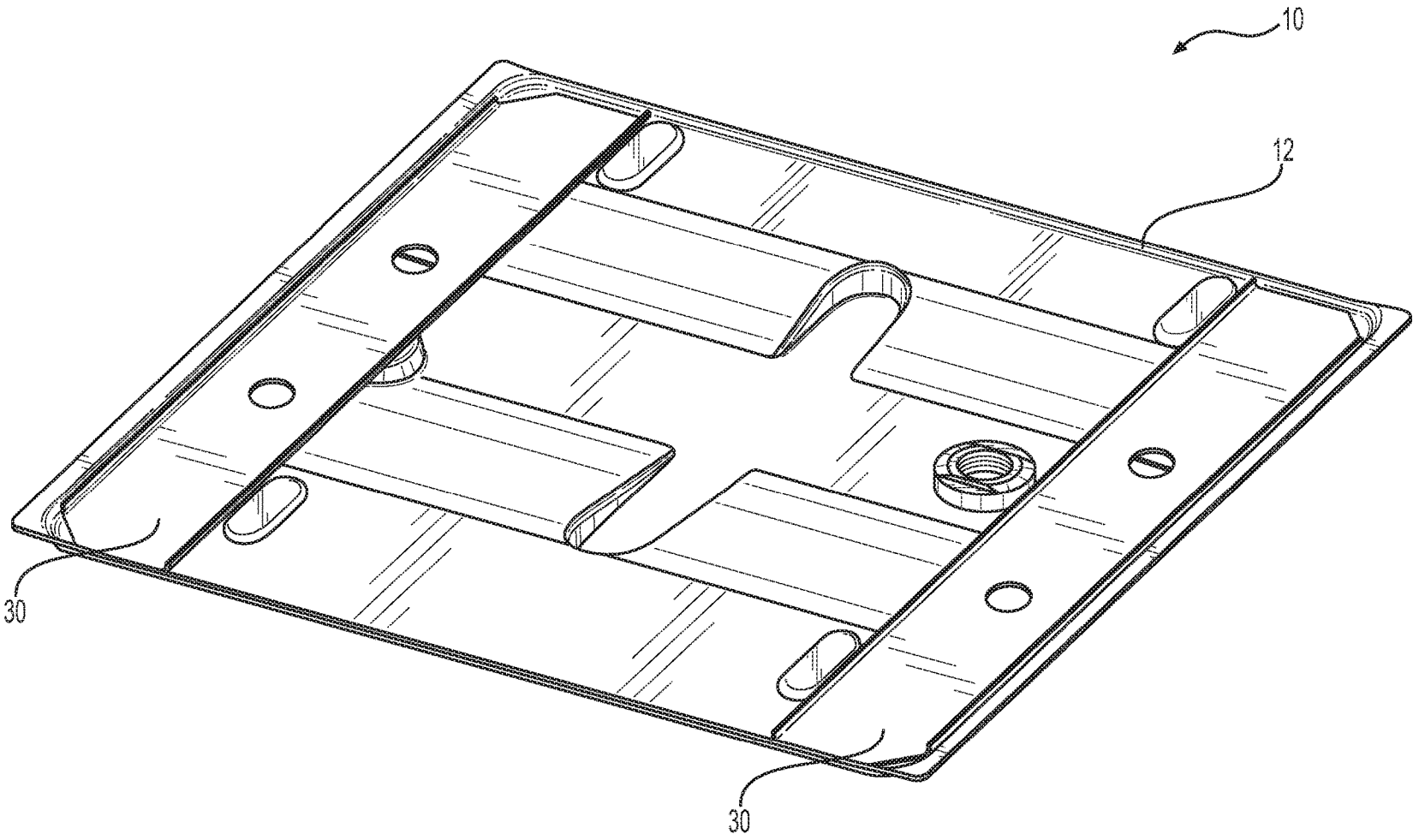
FIG. 4 is a perspective view of the drain pan of FIG. 1.
Figure 5:
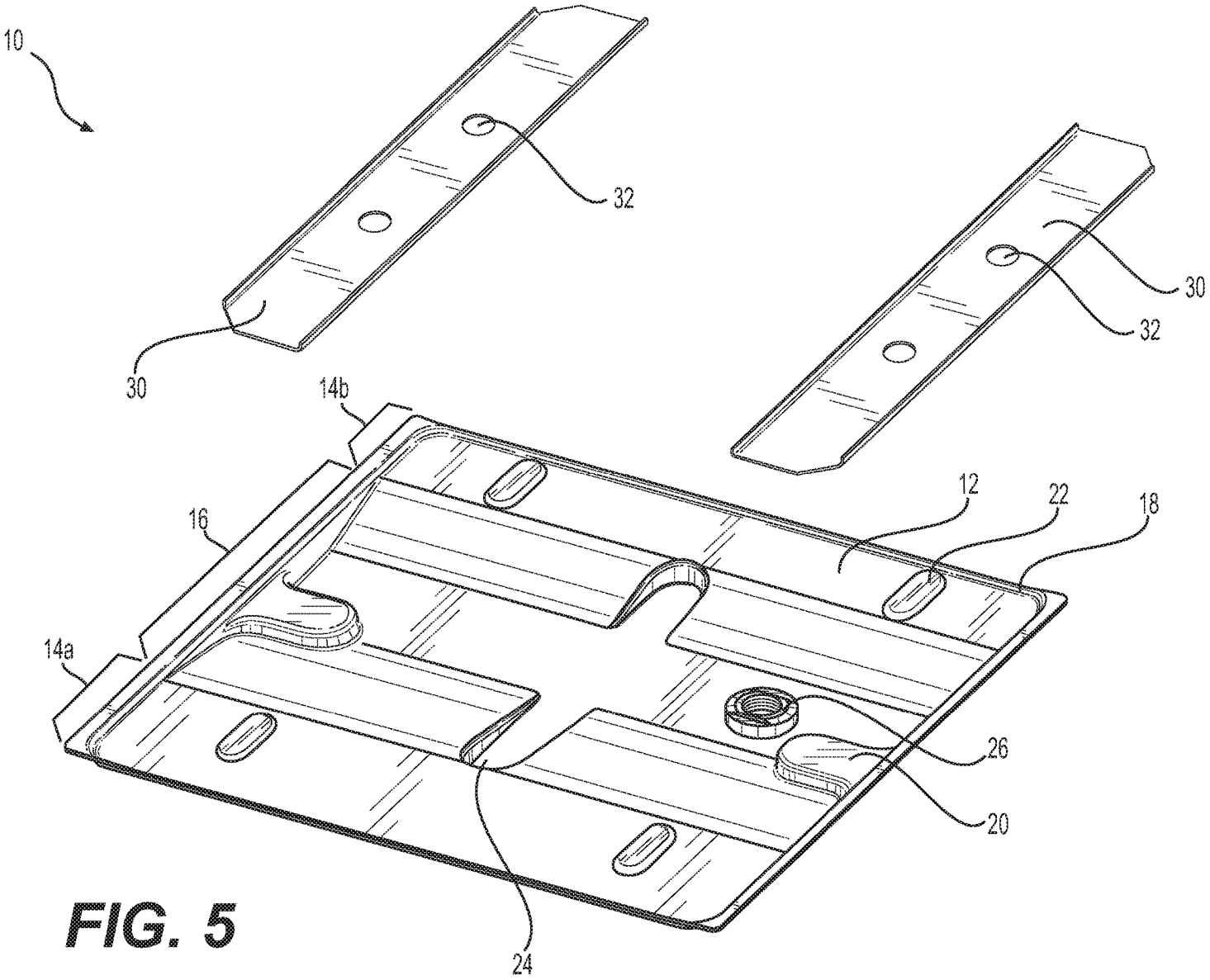
FIG. 5 is an exploded perspective view of the drain pan of FIG. 1.
Figure 6:
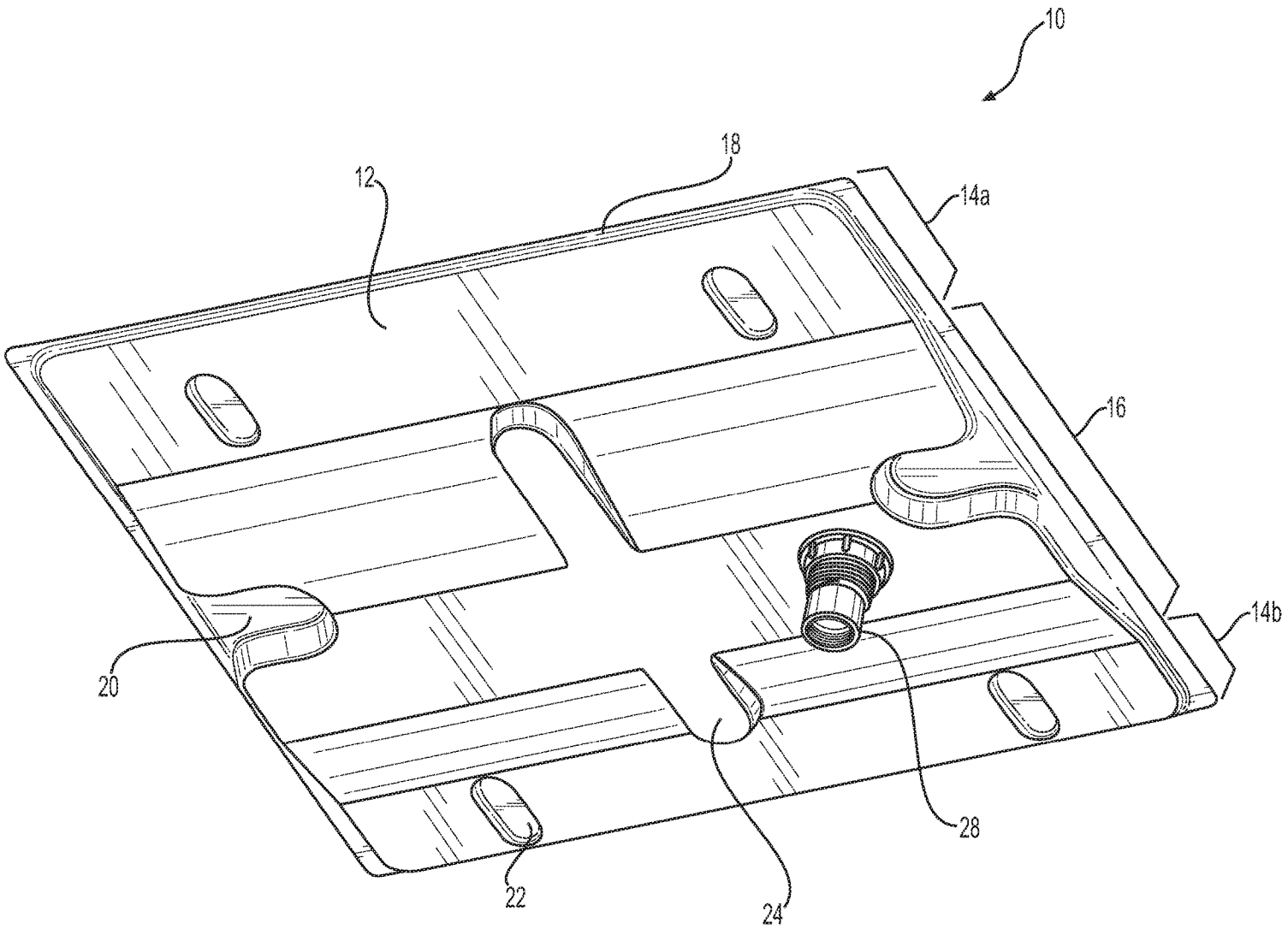
FIG. 6 is a bottom perspective view of the drain pan of FIG. 1.

Between the front and rear shallow portions 14*a*, 15*b*, support pillars 20 project upward from opposing sides of the deeper portion 16. The support pillars 20 each have a generally flat top surface that is at the same level as the front and rear shallow portions 14*a*, 15*b*. In this regard, each support pillar 20 provides support for the corresponding support beam 30 as the support beam 30 spans from the front shallow portion 14*a* to the rear shallow portion 14*b*. In other words, the front end of each support beam 30 sits on the front shallow portion 14*a*, the rear end of each support beam 30 sits on the rear shallow portion 14*b*, and a middle portion of each support beam 30 sits on the support pillar 20, as best seen in FIG. 4.

Four retention protrusions 22 project upward from opposing sides of the front shallow portion 14*a* and from opposing sides of the rear shallow portion 14*b*, spaced apart from the rim 18 a distance slightly greater than the width of the support beams 30. The retention protrusions 22 help keep the support beams 30 in their proper position. Each support beam 30 is retained in position by the rim 18 on its outer side, front end, and rear end, and by the retention protrusions 22 on its inner side, as best seen in FIG. 4. The distance from the rim to each retention protrusion 22 may be selected such that the support beams 30 are loosely retained (a snug fit is typically not necessary).

Figure 7:
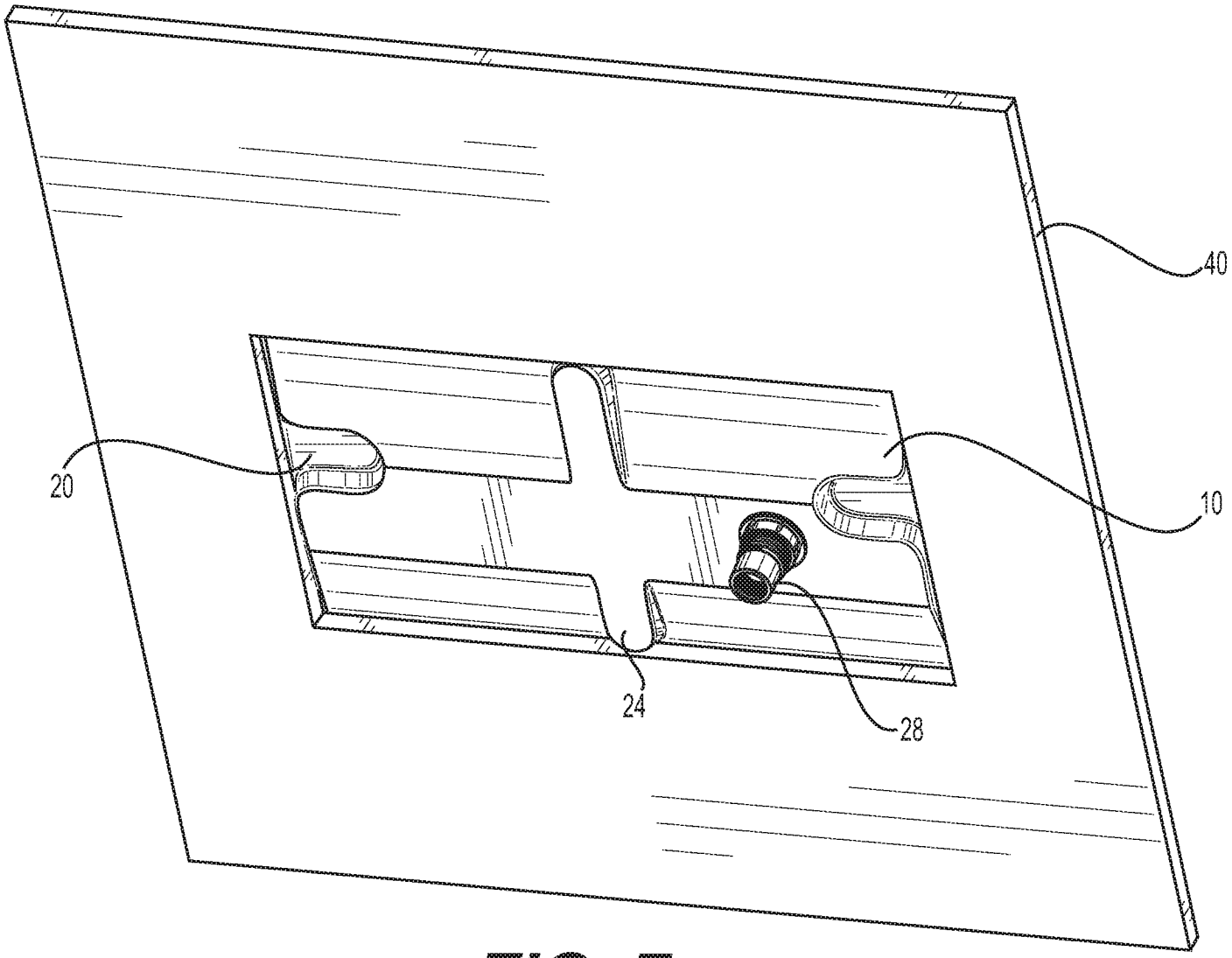
FIG. 7 is a bottom perspective view of the drain pan of FIG. 1, installed in a floor (with the joists omitted for clarity).

Front and rear retention depressions 24 project downward within the deeper portion 16, each providing a vertical surface adjacent, respectively, the front or rear shallow portion 14*a*, 14*b*. The vertical surface of each retention depressions 24 engages, respectively, with the front or rear edge of the installation hole 42, as best seen in FIG. 7, to help retain the drain pan in the installation hole (especially as the appliance is being installed, during which time a rearward pushing motion may be applied to the support beams 30 and therefore to the water-holding portion 12).

The support beams 30 provide supporting surfaces for the appliance legs as the appliance is slid into position and when the appliance is in its final installed position. That is, the legs of the appliance slide along the support beams 30 as the appliance is being slid into its installed position (the left legs of the appliance slid along the left support beam and the right legs of the appliance slid along the right support beam). (Alternatively, the appliance could be lifted into position such that the appliance legs do not slide along the support beams. However, such lifting into place is difficult if not impossible with an undercounter appliance because the counter limits how much the appliance can be lifted during installation.) When in its installed position, the legs of the appliance sit on the support beams (and/or the rear or front ledges, as each appliance leg is positioned generally at a respective corner of the drain pan where a support beam meets/overlaps the rear or front ledge). One or more drainage holes 32 may be defined in the support beams to ensure that any water that leaks onto the support beams readily drains into the water-holding portion 12. The holes 32 are typically positioned over the deeper portion 16, as it is preferable for any such water to drain directly into the deeper portion 16.

While the figures illustrate an installation hole cut into the flooring, it may be necessary or desirable to create the installation hole by building up the area that surrounds where the installation hole should be, or by a combination of cutting and building up. Such building up or forming of the installation hole may be necessary when the flooring is thin (such as when vinyl flooring has been installed on a subfloor that is ¼ inch luan). When the flooring is too thin, cutting an installation hole into the flooring would typically result in an installation hole that is not deep enough to accommodate the deeper portion of the drain pan. The installation hole may be formed by laying plywood or the like of the desired thickness on top of the flooring at the installation location with the installation hole cut into the plywood. The overall size of the plywood would be large enough to accept the deeper portion of the drain pan in the installation hole and to support the front and rear shallow portions of the drain pan. The desired depth of the installation hole is typically ¾ inch. If the installation hole is entirely built up, then ¾ inch plywood would be used. If the installation hole is created by a combination of cutting and building up, then thinner plywood may be used. For example, if the installation hole is created by cutting a hole into a ¼ inch luan subfloor and then building up around the hole cut in the subfloor, ½ inch plywood may be used for the build-up (for a combined depth of ¾ inch). A single piece of plywood may be used to build up the installation hole, such that the installation hole is cut into the plywood. Alternatively, multiple smaller pieces of plywood may be assembled to form four sides surrounding the installation hole.

Figure 8:
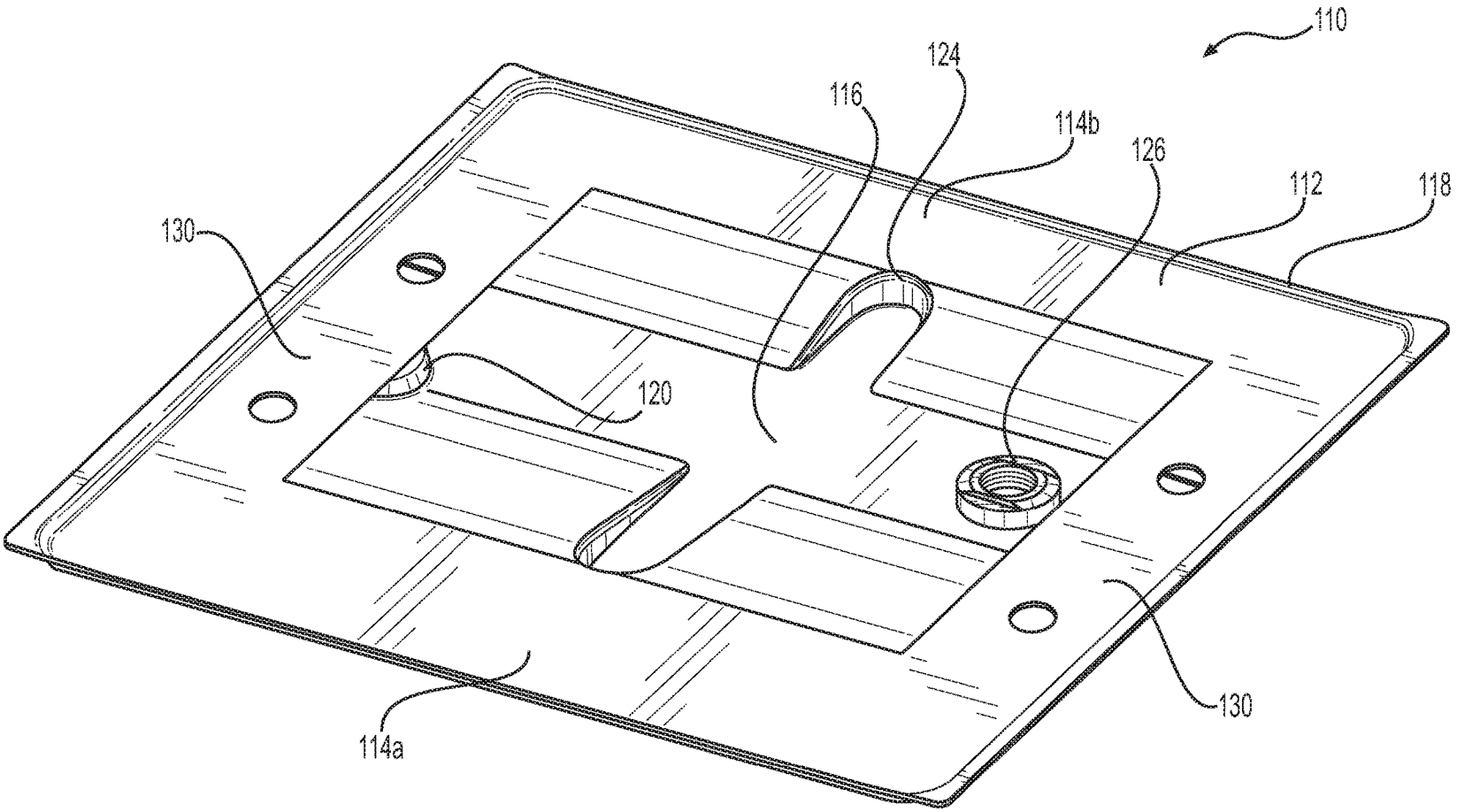
FIG. 8 is a perspective view of an undercounter appliance drain pan installed in a floor, in accordance with alternative embodiments of the present invention.

In alternative embodiments of the invention, the separate support beams may be omitted and side shallow portions extend from front to back on each side of the drain pan. In these alternative embodiments, the side shallow portions provide the supporting surfaces for the appliance legs as the appliance is slid into position and when the appliance is in its final installed position. FIG. 8 illustrates one such alternative embodiment, and FIGS. 9 and 10 illustrate another such alternative embodiments.

FIG. 8 illustrates a drain pan 110 in which a water-holding portion 112 comprises a front shallow portion 114*a*, a rear shallow portion 114*b*, side shallow portions 130 spanning the front and rear shallow portions 114*a*, 114*b*, and a deeper portion 116 between the front and rear shallow portions 114*a*, 114*b*. An upwardly-projecting rim 118 surrounds the water-holding portion 112. Unlike the embodiment of FIGS. 1-7, the front and rear shallow portions 114*a*, 114*b* and the side shallow portions 130 of drain pan 110 are unitary (and also typically unitary with the rim 118). The deeper portion 116 extends under the side shallow portions 130, such that the deeper portion 116 is generally the same size as in the embodiment of FIGS. 1-7. Although not clearly demarcated in FIG. 8, the left and right side shallow portions 130 may be considered to extend from the front rim to the rear rim of the drain pan 110.

The front and rear shallow portions 114*a*, 114*b* sit on the flooring and support the drain pan on the flooring while the deeper portion 116 projects downward into the installation hole, as in the embodiment of FIGS. 1-7. A drain hole 126 is defined in the central portion of the deeper portion 116. As in the embodiment of FIGS. 1-7, support pillars 120 project upward from opposing sides of the deeper portion 116 between the front and rear shallow portions 114*a*, 114*b* to provide support for the side shallow portions 130. Also as in the embodiment of FIGS. 1-7, front and rear retention depressions 124 project downward within the deeper portion 116, each providing a vertical surface that engages, respectively, with the front or rear edge of the installation hole to help retain the drain pan in the installation hole.

Figure 9:
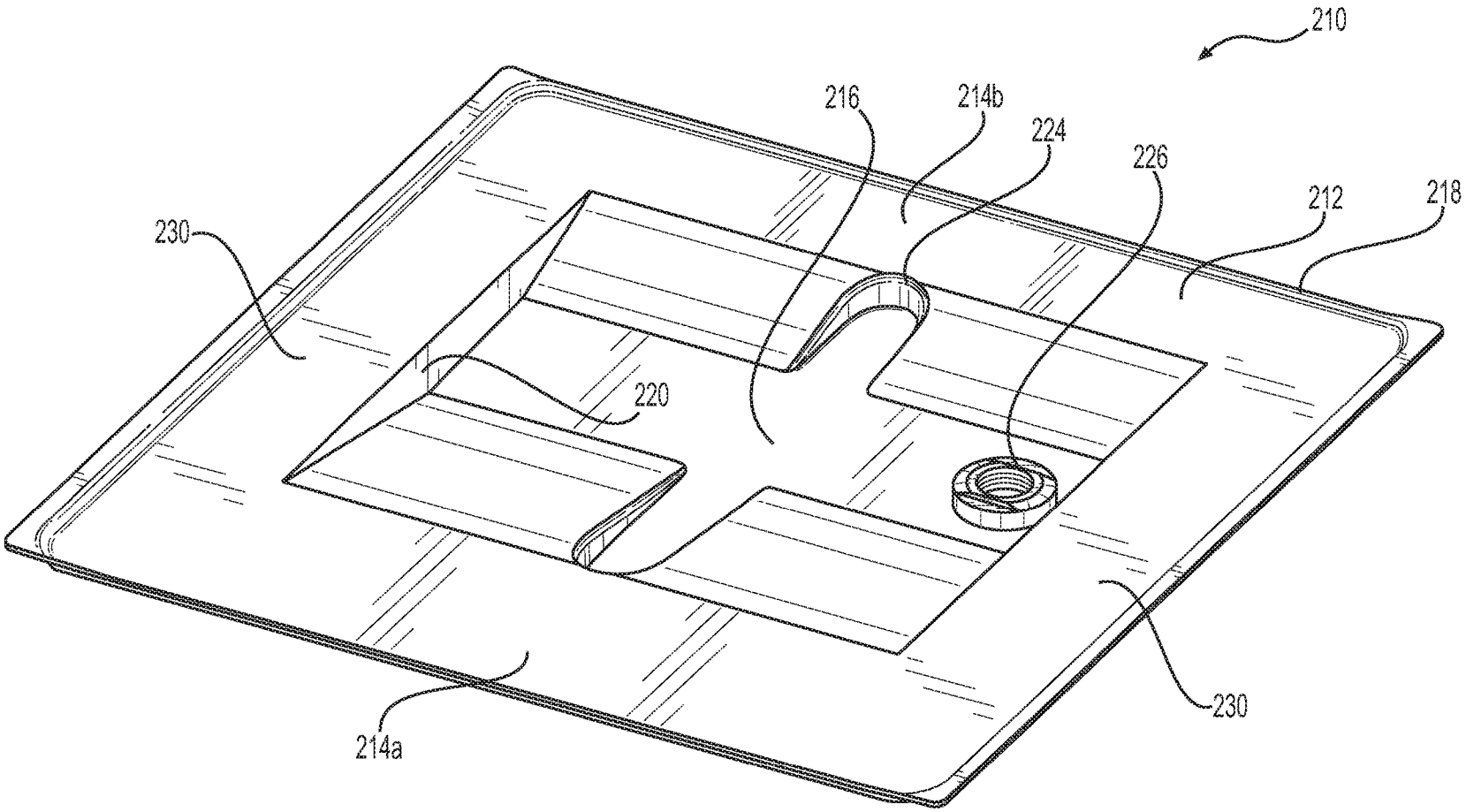
FIG. 9 is a perspective view of an undercounter appliance drain pan installed in a floor, in accordance with alternative embodiments of the present invention.
Figure 10:
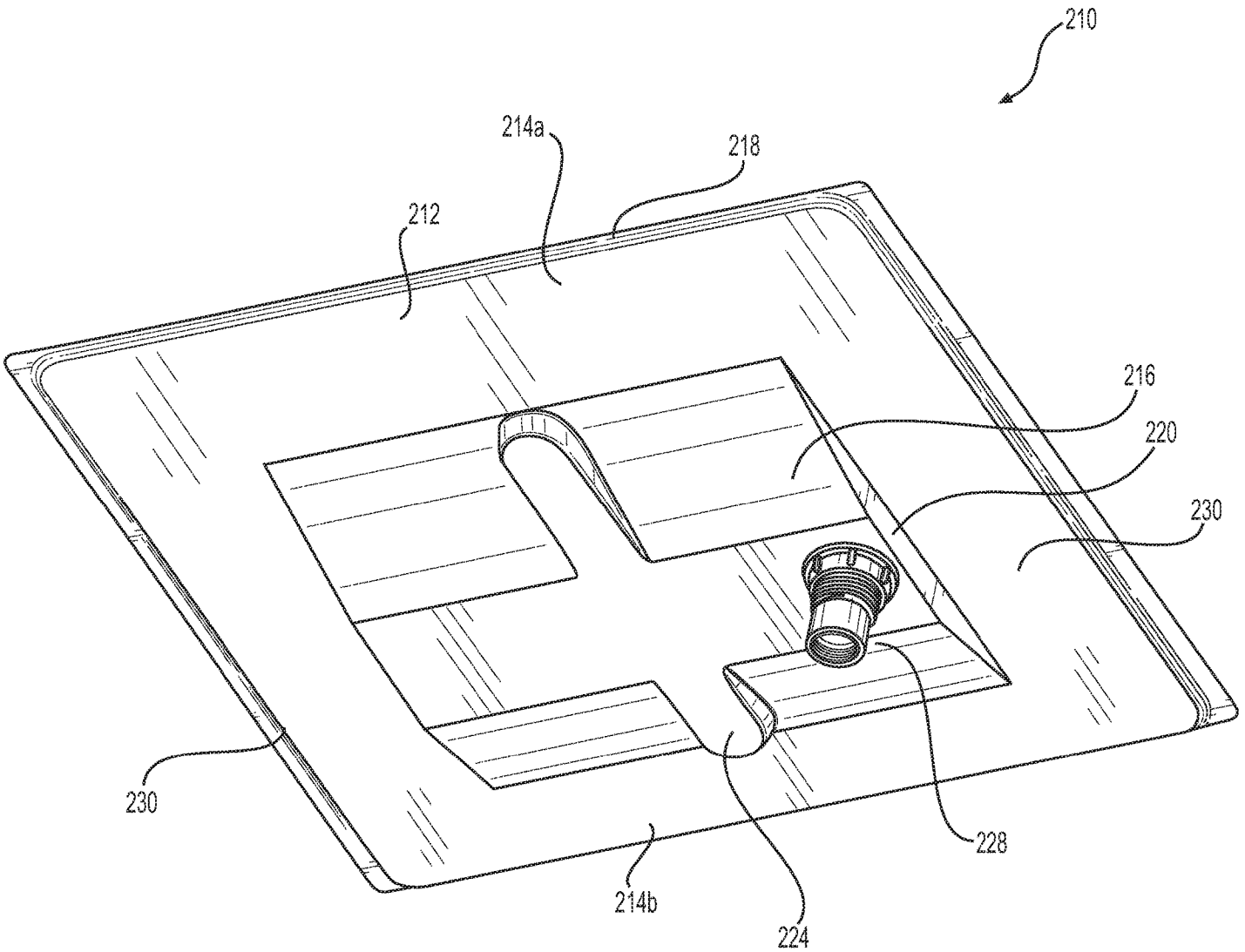
FIG. 10 is a bottom perspective view of the drain pan of FIG. 9.

FIGS. 9 and 10 illustrate a drain pan 210 in which a water-holding portion 212 comprises a front shallow portion 214*a*, a rear shallow portion 214*b*, side shallow portions 230 spanning the front and rear shallow portions 214*a*, 214*b*, and a deeper portion 216 between the front and rear shallow portions 214*a*, 214*b*. An upwardly-projecting rim 218 surrounds the water-holding portion 212. Unlike the embodiment of FIGS. 1-7, the front and rear shallow portions 214*a*, 214*b* and the side shallow portions 230 of drain pan 210 are unitary (and also typically unitary with the rim 218). Unlike the embodiment of FIG. 8, the deeper portion 216 does not extend under the side shallow portions 230, such that the deeper portion 216 (and therefore the installation hole) is smaller than in the embodiment of FIGS. 1-7 and the embodiment of FIG. 8. Opposing vertical walls 220 form the opposing sides of the deeper portion 216 where the deeper portion 216 meets the side shallow portions 230. Although not clearly demarcated in FIG. 9, the left and right side shallow portions 230 may be considered to extend from the front rim to the rear rim of the drain pan 210.

The front and rear shallow portions 114*a*, 114*b* and the side shallow portions 230 sit on the flooring and support the drain pan on the flooring while the deeper portion 216 projects downward into the installation hole (unlike the embodiments of FIGS. 1-7 and FIG. 8, the side shallow portions 230 of drain pan 210 also sit on the flooring). A drain hole 226 (with fitting 228) is defined in the central portion of the deeper portion 216. As in the embodiment of FIGS. 1-7 and FIG. 8, front and rear retention depressions 224 project downward within the deeper portion 216, each providing a vertical surface that engages, respectively, with the front or rear edge of the installation hole to help retain the drain pan in the installation hole.

In addition to the undercounter appliance drain pan, as described above, other embodiments of the invention are directed to corresponding methods for installing an undercounter appliance drain pan as described above and methods for capturing and draining water leaking from an undercounter appliance using the undercounter appliance drain pan described above.

The drain pan of embodiments of the invention may also be used for appliances that are not installed under a counter. For example, the drain pan of embodiments of the invention may be used under a washing machine (a larger version of the drain pan would typically be necessary due to the larger size of a washing machine as compared to dishwasher). Installing a drain pan of embodiments of the invention under a washing machine or other non-undercounter appliance would typically be easier since there is no counter to restrict lifting of the appliance into position.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. An appliance drain pan comprising:

a continuous upturned rim around an outer edge of the drain pan, the rim having a top edge;

horizontal left and right side support ledges enclosed by the rim;

a horizontal rear ledge and a horizontal front ledge; and a central depression between the horizontal left and right side support ledges, the central depression being deeper than the side support ledges relative to the top edge of the rim, at least a portion of the central depression extending under at least a portion of each of the side support ledges wherein the central depression is between and deeper than the rear and front ledges;

wherein the central depression comprises a rear sloped wall adjacent the rear ledge, a front sloped wall adjacent the front ledge, and a horizontal floor, at least part of the horizontal floor being between the rear and front sloped walls;

wherein the rear sloped wall comprises a vertical wall portion adjacent the rear ledge;

wherein the front sloped wall comprises a vertical wall portion adjacent the front ledge;

wherein a portion of the horizontal floor extends to the vertical wall portion of the rear sloped wall; and wherein a portion of the horizontal floor extends to the vertical wall portion of the front sloped wall.

2. The drain pan of claim 1, wherein the rear, front, and side ledges are unitary.

3. The drain pan of claim 1, wherein each side support ledge comprises an elongated beam removably positionable on the rear and front ledges with one end of each side support ledge sitting on the rear ledge and an opposing end of each side support ledge sitting on the front ledge, each side support ledge positioned over an opposing end of the central depression.

4. The drain pan of claim 1, wherein one or more drain holes are defined in each side support ledge, each drain hole being positioned over the central depression.

5. The drain pan of claim 1, further comprising left and right support pillars projecting upward from the central depression, each support pillar contacting an underside of a corresponding side support ledge to support the corresponding side support ledge.

6. The drain pan of claim 1, wherein a drain hole is defined in the central depression.

7. A method of installing an appliance, the appliance comprising a left rear leg, a right rear leg, a left front leg, and a right front leg, the method comprising:

(a) cutting and/or forming an installation hole in a floor in a location where the appliance is to be installed;

(b) obtaining an appliance drain pan, the drain pan comprising:

an upturned rim around an outer edge of the drain pan, the rim having a top edge;

horizontal left and right side support ledges; and a central depression between the horizontal left and right side support ledges, the central depression being deeper than the side support ledges relative to the top edge of the rim;

(c) positioning the drain pan such that the central depression sits down in the installation hole; and (d) sliding or lifting the appliance into position on top of the drain pan along the side support ledges.

8. The method of claim 7, wherein at least a portion of the central depression extends under at least a portion of each of the side support ledges.

9. The method of claim 7, wherein the drain pan further comprises a horizontal rear ledge and a horizontal front ledge; and wherein the central depression is between and deeper than the rear and front ledges.

10. The method of claim 9, wherein the rear, front, and side support ledges are unitary.

11. The method of claim 9, wherein each side support ledge comprises an elongated beam removably positionable on the rear and front ledges with one end of each side support ledge sitting on the rear ledge and an opposing end of each side support ledge sitting on the front ledge, each side support ledge positioned over an opposing end of the central depression.

12. The method of claim 9, wherein the central depression comprises a rear sloped wall adjacent the rear ledge, a front sloped wall adjacent the front ledge, and a horizontal floor, at least part of the horizontal floor being between the rear and front sloped walls.

13. The method of claim 9, wherein the rear sloped wall comprises a vertical wall portion adjacent the rear ledge;

wherein the front sloped wall comprises a vertical wall portion adjacent the front ledge;

wherein a portion of the horizontal floor extends to the vertical wall portion of the rear sloped wall;

wherein a portion of the horizontal floor extends to the vertical wall portion of the front sloped wall; and wherein positioning the drain pan further comprises positioning the drain pan such that the vertical wall portion adjacent the rear ledge abuts the rear edge of the installation hole and such that the vertical wall portion adjacent the front ledge abuts the front edge of the installation hole.

14. The method of claim 7, wherein one or more drain holes are defined in each side support ledge, each drain hole being positioned over the central depression.

15. The method of claim 7, further comprising left and right support pillars projecting upward from the central depression, each support pillar contacting an underside of a corresponding side support ledge to support the corresponding side support ledge.

16. The method of claim 7, wherein a drain hole is defined in the central depression.

* * * * *